US005353261A

United States Patent [19]

Kakiuchi et al.

[11] Patent Number: 5,353,261

[45] Date of Patent: Oct. 4, 1994

[54] VIBRATING APPARATUS

[75] Inventors: Yoshihiko Kakiuchi, Neyagawa; Kimihiro Andoh, Matsusaka; Shingo Tamura, Kitakatsushika; Ryuzou Ishigaki, Yokohama, all of Japan

[73] Assignees: Matsushita Electric Industrial Co., Ltd., Kadoma; Vank Corporation; ECS-88 Company, Limited, both of Tokyo, all of Japan

[21] Appl. No.: 57,754

[22] Filed: May 7, 1993

[30] Foreign Application Priority Data

May 14, 1992 [JP] Japan ..... 4-121726

[51] Int. Cl.[5] ..... H04R 23/00

[52] U.S. Cl. ..... 367/140; 181/196; 381/154; 128/33; 128/38; 601/57

[58] Field of Search ..... 181/196; 381/154; 128/38, 33; 367/140

[56] References Cited

U.S. PATENT DOCUMENTS 5,135,282 8/1992 Pappers ..... 297/284 B

FOREIGN PATENT DOCUMENTS 3-26200 2/1991 Japan .

*Primary Examiner*—J. Woodrow Eldred

*Attorney, Agent, or Firm*—Cushman, Darby & Cushman

[57] ABSTRACT

A hollow member having a continuous sound-waveguide therein is formed by a plate shaped rigid base member microwave welded to an overriding member of flexible and semi-rigid plastic made, e.g., by vacuum forming. A speaker and an amplifier are confined in the hollow member which is filled with gas. The shape, material and thickness of the hollow member is selected to have a strength capable of retaining the shape of a sound-waveguide without an airpressure within the hollow member against reasonable external forces imposed, such as when under the usual condition of use on the back or seat of a chain.

7 Claims, 3 Drawing Sheets

VIBRATING APPARATUS

FIELD OF THE INVENTION AND RELATED ART STATEMENT

1. Field of the Invention

The present invention relates to a vibrating apparatus, whereby a sound signal is made physically sensible as vibration to a user touching whereto by converting an electrical sound signal into a mechanical vibration. Thus it relates to a vibrating apparatus which can be installed, for example, on a front side of the back and/or on a seat of a chair, thereby to propagate the vibration to a person sitting on the chair through the body.

2. Description of the Related Art

A conventional vibrating apparatus is described referring to FIG. 4 and FIG. 5 (reference being made to Japanese Published Unexamined Patent Application No. Hei 3-26200).

FIG. 4 is a perspective view of the conventional vibrating apparatus of this type, and FIG. 5 is a sectional view taking along a line V—V' of FIG. 4 to show the sectional shape of a portion of a sound-waveguide of the conventional vibrating apparatus. FIG. 4 shows a sound-waveguide (a sound propagating path) utilized by injecting gas (air) into a hollow member.

The conventional vibrating apparatus is now described with reference to the drawings. In FIG. 4, an electrical sound signal sent over a signal wire from an amplifier is input to a speaker, which is an electrical vibration converting device such as a cone-type dynamic speaker.

A driver case 12 incorporates the cone-type dynamic speaker. A tubular bag 13 (an air bag) is usually constituted of two plies of soft polyvinyl chloride sheets which are welded together at the edges by microwave welding and inflated by a gas or air therein, so as to form a continuous loop-connected zigzag sound-waveguide. The series sound-waveguide in the tubular bag 13 is disposed in a zigzag manner. When a positive-phase sound is irradiated to one end of the sound-waveguide from one vibrating face of the cone-type dynamic speaker, a negative-phase sound is irradiated to the other end of the sound-waveguide from the other vibrating face of the cone-type dynamic speaker. An air plug 14 is connected by microwave welding and is for filling and sealing the air into the tubular bag 13.

In FIG. 5, the upper and lower plies of soft polyvinyl chloride sheets 15, 16 are welded together making welds 17 of the upper and lower plies to constitute the tubular bag 13 of FIG. 4.

The conventional vibrating apparatus contains gas or air filled through the air plug 14. Then, the electrical sound signal over the signal wire is applied to the speaker incorporated in the driver case 12, and thereby the air inside the air bladder is vibrated by the sound vibration of the speaker and propagates as pressure waves. As a result, the entire tubular bag 13 is vibrated. Thus, when a user is sitting on a chair, wherein the above-mentioned vibrating apparatus is inserted, for example, between the front face of a back of the chair and a sitting person's back, the electrical sound signal can be physically sensed as mechanical vibration.

In the above-mentioned conventional vibrating apparatus, the tubular bag 13 was constituted to keep a predetermined shape of the sound-waveguide by confining gas or air into the airtight tubular bag 13. The tubular bag 13 forming the sound-waveguide is constituted by two plies of very thin polyvinyl chloride sheets of about 0.2 to 0.25 mm thick. These two sheets are welded together. The resultant tubular bag has no substantial rigidity or strength by itself to retain the shape, and the predetermined shape of the tubular sound-waveguide is retained only by confining therein the gas or air of a pressure slightly higher than the environment, utilizing its airtightness.

Thus, it was problematic that, when the soft polyvinyl chloride sheets 15, 16 are pierced by contact with an external pointed object and the air leaks out, the tubular bag 13 can not retain the shape forming the sound-waveguide. Therefore the physically sensed vibration can not be maintained.

It was also problematic that the gas or air inside the tubular bag 13 expands and the internal pressure rises due to an increase in the ambient temperature, and thereby the welds 17 of the soft polyvinyl chloride sheets 15, 16 are broken. Then the tubular bag 13 ruptures causing air leaks, and as a result the sound-waveguide form can not be maintained.

OBJECT AND SUMMARY OF THE INVENTION

It is therefore an object of the present invention to provide a vibrating apparatus capable of reliably retaining a form of the sound-waveguide, thereby preventing a deterioration of the physically sensed vibration.

A vibrating apparatus is provided comprising:

a hollow member having a flexibility and provided with a serial or continuous sound-waveguide therein, the hollow member having strength capable of retaining a sound-waveguide formed shape against external forces imposed under usual use conditions, and an electrical vibration converting device for irradiating a sound in the sound-waveguide to vibrate the hollow member through gas confined in the sound-waveguide. In order to give the hollow member strength capable of retaining the sound-waveguide shape, a sectional shape, material or thickness of the hollow member are set adequately.

According to the present invention, the hollow member is constituted to have a rigidity and strength capable of retaining the formed shape of the sound-waveguide against external forces imposed, at least, under usual use conditions. Therefore, the formed sound-waveguide can be retained reliably by the rigidity and strength of the hollow member itself, thereby preventing deterioration of the physically sensitive vibration without the use of added gas or air filled in the hollow member.

Also, because of the hollow member itself having a substantial strength and rigidity, it is never pierced by an accidental contact with a pointed object or ruptured by a temperature rise. Therefore, it is easy to keep airtightness therein.

It will be recognized that some or all of the Figures are schematic representations for purposes of illustration and do not necessarily depict the actual relative sizes or locations of the elements shown.

DESCRIPTION OF THE PREFERRED EMBODIMENT

Embodiments of the present invention are now described with reference to the drawings.

Embodiments 1

Figure 1:
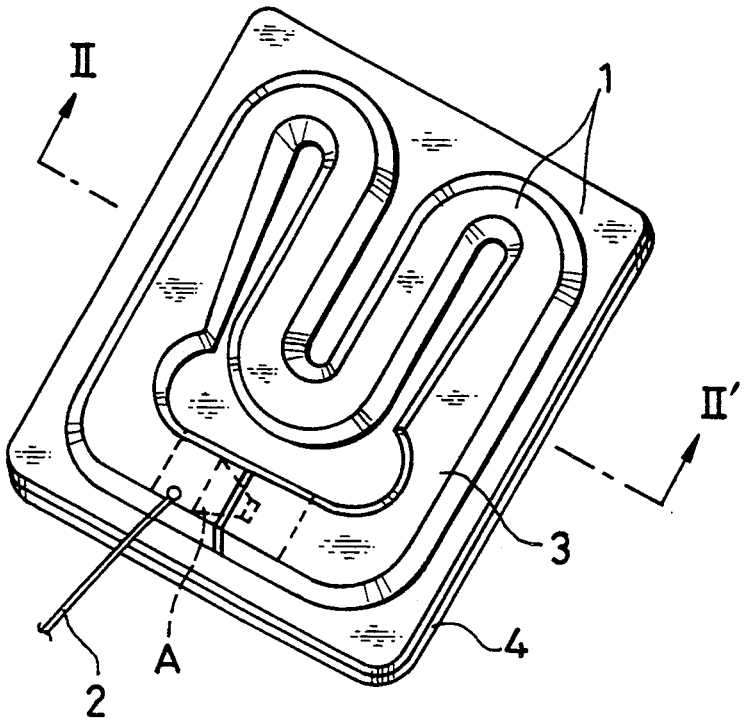
FIG. 1 is a perspective view showing a configuration of a vibrating apparatus of a first embodiment of the present invention.
Figure 2:
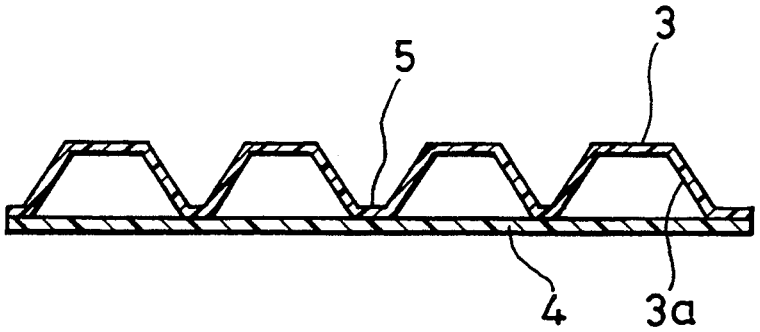
FIG. 2 is a section view taken along a line II—II' of FIG. 1.

FIG. 1 is a perspective view of a vibrating apparatus of a first embodiment of the present invention, and FIG. 2 is a sectional view taken along a line II—II' of FIG. 1 showing a sectional shape of a portion of a sound-waveguide of the vibrating apparatus of the first embodiment.

The vibrating apparatus of the first embodiment is described referring to FIG. 1 and FIG. 2. In FIG. 1, a hollow member 1 made of a flexible material is formed to have a serial and loop-connected zigzag sound-waveguide therein. Sectional shape, material and/or thickness and so on of the hollow member 1 are set so as to have rigidity and strength capable of retaining the formed shape of a sound-waveguide against external forces imposed, at least, under usual use conditions with a load applied thereto when a person sits on a chair. An input wire 2 inputs an electrical sound signal to a speaker A which is an electrical signal to sound converting device incorporated in the sound-waveguide as will be described later. The speaker A, which is the electrical sound converting device, is designed to emit a sound in the continuous loop-connected sound-waveguide inside the hollow member 1 to thereby vibrate the walls of the hollow member 1 through the gas or air filled inside the sound-waveguide.

As shown in FIG. 2, the hollow member 1 is constituted by two flexible or resilient members 3, 4. An overriding member 3 is provided on and fixed to a base member 4. Both members 3, 4 are overlapped and welded together by microwave welding or heat welding. The overriding flexible member 3 is thinner than the base member 4 and may be made stronger if formed into an arch shape such as with a trapezoidal shell section, a semi-cylindrical section, or the like. It is formed of a sheet 0.8 to 3.0 mm thick of a material such as polypropylene (hereinafter abbreviated as PP), polyvinyl chloride (hereinafter abbreviated as PVC), polyethylene (hereinafter abbreviated as PE), polystyrene (hereinafter abbreviated as PS) or the like. The overriding member 3 sheet is formed into serial continuous loop-connected zigzag channel-shaped depressions 3*a* by means of, e.g., vacuum forming, so as to form the upper part of the sound-waveguide. The base member 4 is formed by punching a flexible sheet such as PP, PVC, PE, PS or the like into a square or a rectangular plate shape. The lower edges of the overriding member 3 are welded to the base member 4 as shown at welds 5.

This embodiment of a vibrating apparatus therefore provide an overriding member 3 having the depressions 3*a* forming the sound-waveguide and the plate-shaped base member 4 assembled together by welding, a speaker A, whereto the input wire 2 of the electrical sound signal is connected, are fixed to and sealed in the sound-waveguide formed by the depressions 3*a*.

As compared with the conventional apparatus made with the conventional soft vinyl chloride, the above-mentioned flexible members 3, 4 have a larger mechanical strength, and therefore the assembled vibrating apparatus does not break even when contacted by a pointed object, and thus the shape of a sound-waveguide can be maintained. Even when an inner pressure of the hollow member 1 becomes high due to a temperature rise, they do not rupture.

According to this vibrating apparatus, a sectionally shaped material and thickness are selected such that the hollow member 1 has a strength capable of retaining the formed shape of a sound-waveguide against external forces imposed. Accordingly, at least under usual use conditions, the shape of a sound-waveguide can be reliably retained by the strength of the hollow member 1 itself. Therefore, deterioration of the physically sensitive vibration is prevented. Furthermore, there is no need to inflate the hollow member 1 with a gas or air during use, or replenishing the gas or air when the internal air has decreased.

Since the hollow member 1 itself has strength, it is easy to retain and secure the hollow member 1 in its designed shape of the sound-waveguide, without the possibility of being pierced by contact with a pointed object or of being ruptured by a rise in temperature or heat radiated from an amplifier. Thus, a fatal loss of the inner pressure of the hollow member 1 leading to a collapse of the sound-waveguide can be reduced, and variations in the vibration can be limited.

Embodiment 2

Figure 3:
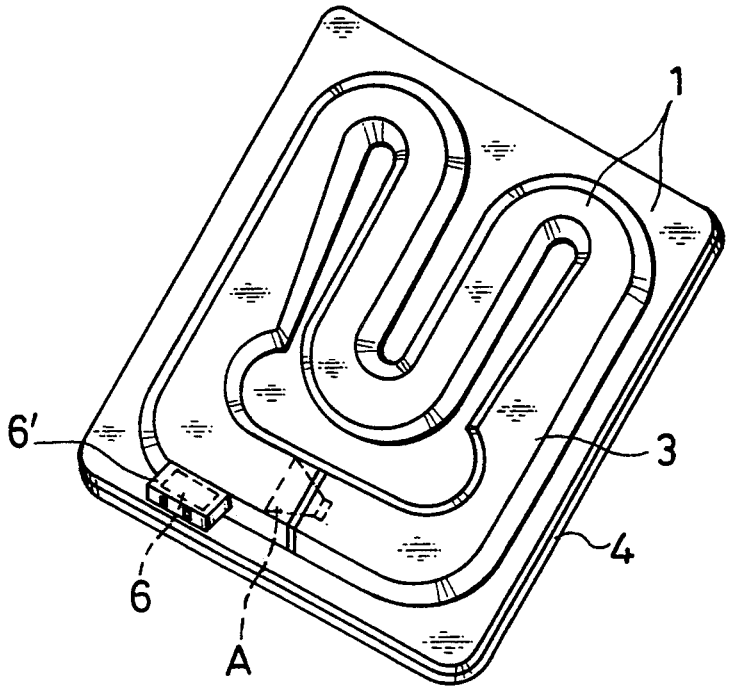
FIG. 3 is a perspective view showing a configuration of a vibrating apparatus of a second embodiment of the present invention.
Figure 4:
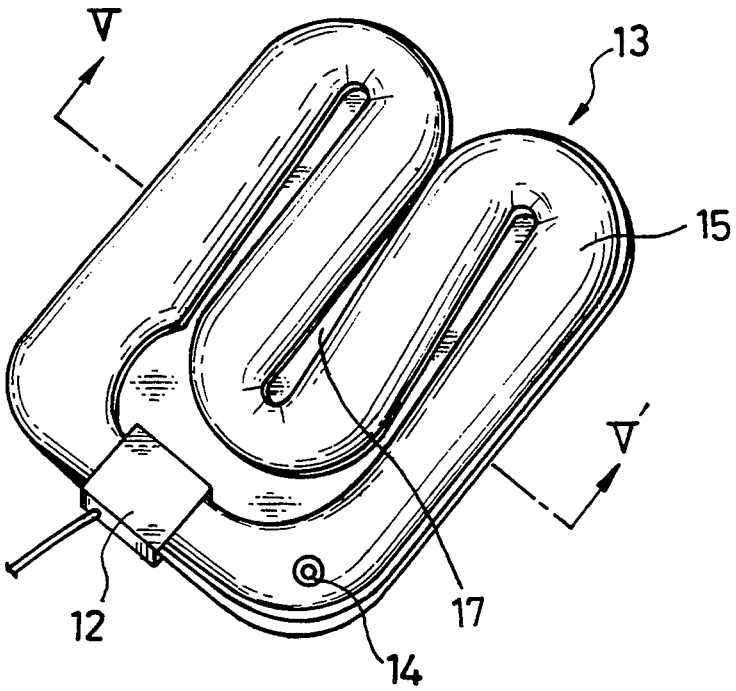
FIG. 4 (Prior Art)
FIG. 4 is a perspective view showing a configuration of a conventional vibrating apparatus.
Figure 5:
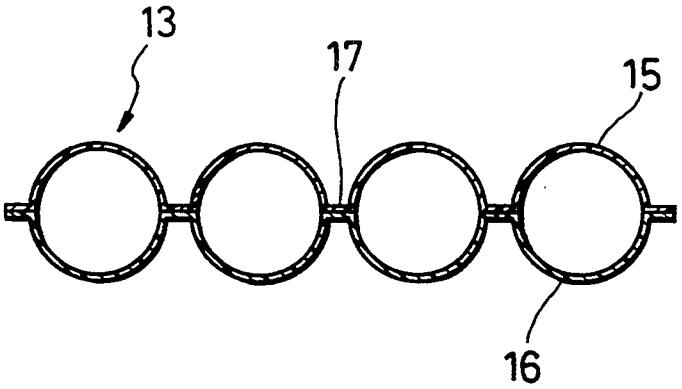
FIG. 5 (Prior Art)
FIG. 5 is a sectional view taken along a line V—V' of the vibrating apparatus of FIG. 4 showing a state where gas is injected.

FIG. 3 is a perspective view of a vibrating apparatus of a second embodiment of the present invention.

The second vibrating apparatus is described with reference to FIG. 3. In this vibrating apparatus, an amplifier 6 for amplifying an electrical sound signal to supply to a speaker A is electrically connected to the speaker A, and the amplifier 6 is also incorporated at an attached compartment 6' to the hollow member 1, together with the speaker. Other than the attached compartment 6' and the amplifier, this embodiment is similar to FIG. 1, and the aforementioned descriptions of it similarly apply. In the hollow member 1, the compartment 6' for containing the amplifier 6 is formed beforehand near the speaker A. Therefore, part 6' of the hollow member 1 serves as an amplifier case.

In this second embodiment vibrating apparatus, not only the speaker A which converts the electrical signal into the mechanical vibration, but the amplifier 6 which amplifies the electrical sound signal is also incorporated in and fixed to the hollow member 1. By overlapping the overriding member 3 onto the base member 4 and welding both members confining the speaker A and the amplifier 6 in the hollow member 1, the amplifier 6 is fixed and sealed in the hollow member 1. The other configurations are similar to those of the first embodiment.

According to this second embodiment, since the amplifier 6 is incorporated in the hollow member 1, a separate amplifier case is not required. Thus the number of parts can be reduced, resulting in an improvement in productivity and a reduction in manufacturing cost. Other effects and advantages are similar to those of the first embodiment.

Though in the above-mentioned embodiments, the hollow member 1 has been described as being airtight, the airtightness for retaining the shape of the sound-waveguide is not particularly required since the shape of the sound-waveguide can be retained by the strength and rigidity of the hollow member 1 itself.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications that fall within the true spirit and scope of the invention.

What is claimed is:

1. A vibrating apparatus comprising:

a flexible hollow member having a continuous cavity forming an air-tight sound-waveguide therein, said hollow member having a strength capable of retaining a formed shape of the sound-waveguide against external forces imposed under usual using situation, and electrical vibration converting means in said hollow member for irradiating a sound in said sound-waveguide;

wherein said irradiating sound vibrates said hollow member; and wherein a vertical cross section of said sound-waveguide has an arch shape.

2. A vibrating apparatus in accordance with claim 1, wherein said hollow member includes:

a flexible flat base member; and an overriding flexible member having a continuous concave area forming at least a portion of said sound-waveguide;

said overriding flexible member being secured to said flat base member to form said sound-waveguide therebetween.

3. A vibrating apparatus in accordance with claim 1 or claim 2, wherein said electrical vibration converting means and an amplifier for driving said electrical vibration converting means are incorporated within said hollow member.

4. A vibrating apparatus in accordance with claim 2, wherein said overriding member is secured to said base member by a microwave weld.

5. An apparatus for converting an electrical sound signal into a mechanical vibration comprising:

a flexible base member;

a flexible formed member having a continuously concave portion forming a sound waveguide, said formed member being secured to said base member to make said concave portion into an airtight cavity; and electrical vibration converting means in said airtight cavity for vibrating said formed member;

wherein said sound waveguide of said formed member is air-tight and not pressurized; and wherein a vertical cross section of said sound waveguide has an arch shape.

6. An apparatus for converting an electrical sound signal into a mechanical vibration according to claim 5, further comprising an amplifier for driving said electrical vibration converting means.

7. An apparatus for converting an electrical sound signal into a mechanical vibration according to claim 5, wherein said base member and said formed member are formed of poly plastic.

* * * * *